United States Patent [19]

Nelson

[11] 3,934,658

[45] Jan. 27, 1976

[54] MODULAR UNDERWATER WELL PLATFORM SYSTEM

[76] Inventor: Norman A. Nelson, 2422 W. 18th St., Apt. 169, Houston, Tex. 77008

[22] Filed: Sept. 19, 1974

[21] Appl. No.: 507,182

[52] U.S. Cl. ..... 175/7; 61/46

[51] Int. Cl.[2] ..... E21B 15/02

[58] Field of Search ..... 175/7–10; 173/45; 61/46, 46.5

[56] References Cited

UNITED STATES PATENTS

| | | | |
|---|---|---|---|
| 2,657,540 | 11/1953 | Templeton | 61/46.5 |
| 2,747,840 | 5/1956 | Miles | 175/9 |
| 2,863,293 | 12/1958 | Plumer | 61/46.5 |
| 3,176,470 | 4/1965 | Stiff | 61/46 |
| 3,364,684 | 12/1968 | Sandberg | 61/46 |
| 3,517,735 | 6/1970 | Fairbanks et al. | 166/.5 |
| 3,626,447 | 12/1971 | Hindlin | 61/46.5 |
| 3,797,256 | 3/1974 | Giblon | 61/46.5 |

*Primary Examiner*—Frank L. Abbott
*Assistant Examiner*—Richard E. Favreau
*Attorney, Agent, or Firm*—Fulbright & Jaworski

[57] ABSTRACT

A modular underwater well platform system comprising a plurality of modular units which are assembled and connected to the underwater floor based on results obtained as drilling of wells progresses and which allows flexibility in the positioning, size, and location of the platform while reducing the expense and time required for manufacturing and construction of the platform. A first guide base is provided connected to the underwater floor by the initial exploratory well pipe and the base includes a plurality of connecting and supporting frames directed outwardly in various directions and having interconnecting elements for allowing interconnection with additional modular guide bases in any of the various directions. After an exploratory well or wells has been drilled through an opening in the first base and when the results of the first wells indicate the location at which the platform is to be constructed, one or more spacer members having first and second ends, the first end of which includes interconnecting elements may be connected to one of the interconnecting elements of one of the frames of the first guide base for extending the base of the platform in the desired direction. One or more additional guide bases may be connected to the second ends of the spacing members and supported from the underwater floor. The platform base can then be extended in any desired direction with the modular components as indicated by the results of further drilling. The interconnecting elements between the guide bases and the spacer members may include vertical telescoping members and locking means. The guide bases may include vertical guide means for coacting with and supporting upper support structures from the guide bases for building up the drilling structure to the desired height.

15 Claims, 17 Drawing Figures

MODULAR UNDERWATER WELL PLATFORM SYSTEM

BACKGROUND OF THE INVENTION

The search for additional oil and gas has turned to deeper underwater locations. Virtually all commercial offshore production is in water less than three hundred feet deep, but plans are going forth for drilling for oil and gas to water depths of greater than 1,000 feet. Various types of drilling platforms have been suggested of various configurations. The design most widely used is the fourleg design having provisions for drilling multiple wells therefrom and which is generally floated to the drill site and secured in place to the underwater floor. However, such platforms are extremely expensive, costing millions of dollars, require a considerable amount of lead time to construct, and once secured in place, cannot readily be modified to meet changing conditions which may be required depending upon the drilling conditions encountered.

The present invention is directed to a modular underwater well drilling platform in which the modules are connected to the underwater floor only when needed and the location and size of the platform is not committed until the field size and location is defined. The modular structure of the present invention offers maximum flexibility with a minimum of cost. The various modular units can be manufactured at different locations to cut down on lead time, the modular units can be made up and stocked for future use, the configuration of the platform can be put together in modular form to meet the varying needs as they are encountered in day-to-day operations, and the modular configuration permits expansion of the platform as conditions dictate at a later date.

SUMMARY

The present invention is directed to a modular underwater well platform system utilizing a modular guide base which is adapted to be connected to the underwater floor wherein the base includes a plurality of connecting and supporting frames directed outwardly in various directions and having interconnecting elements allowing for interconnection with additional modular units in any of the various directions.

A still further object of the present invention is the provision of a plurality of guide bases which may be interconnected in any of a plurality of directions when desired and secured to the underwater floor for forming a base support for a well drilling platform as the results of well testing dictate.

Yet another object of the present invention is the provision of spacer members having first and second ends for connection to one of the connecting and supporting frames of one guide base with a second guide base connected to the second end of the spacer member for locating and positioning a second guide base at a desired direction and distance from the first guide base when desired.

Still a further object of the present invention is the provision wherein the interconnecting elements on the guide base and spacer member include vertical telescoping members and locking means.

Yet a still further object of the present invention is the provision of vertical guide means connected to the guide base for securing additional and further structural members to the guide base.

Yet a still further object of the present invention is the provision of supporting and connecting the guide bases to the underwater floor by connector pipe in which the guide bases include an opening for passage of drill pipe through the bases and conductor pipe for drilling additional wells.

Still a further object of the present invention is the provision of connecting the first guide base to the underwater floor from a pipe and rotatably supporting the guide base from the pipe so that the first guide base may be rotated to modularly add additional units in any desired direction.

Other and further objects, features and advantages will be apparent from the following description of a presently preferred embodiment of the invention, given for the purpose of disclosure, and taken in conjunction with the accompanying drawings.

Description of the Preferred Embodiment

Figure 1:
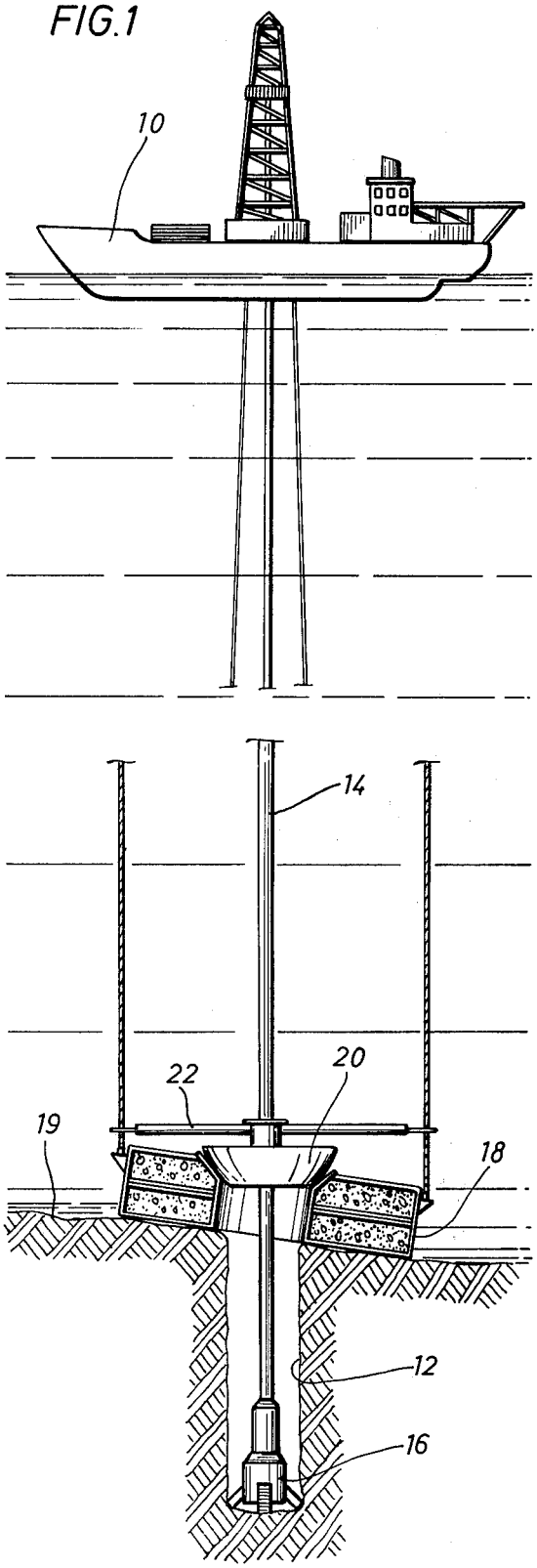
FIG. 1 is an elevational view, showing a floating vessel beginning an underwater well.

Generally, a fixed offshore drilling platform is designed to drill multiple wells in order to reduce the unit cost of the platform per well. However, because a fixed platform is expensive and the prospect for producing oil or gas is unknown, the first well is generally drilled by a retrievable drilling rig such as a floating vessel 10 shown in FIG. 1 which drills an exploratory hole 12 conventionally by a drill string 14 driving a bit 16. The drilling is performed through a temporary base 18 through a gimball joint 20 in which a guide frame 22 centers the drill string 14 relative to the base 18.

It has been conventional to place a conductor pipe 24 into the hole 12 and secure it to the underwater floor 19 by cement 28. The conductor pipe 24 may include a hub 30 for receiving a conventional blowout preventer stack. Drilling is then continued through the conductor pipe 24 from the floating vessel 10. In the event that the results of the drilling is favorable, the floating vessel 10 is generally moved and a fixed drilling platform installed since further drilling and production can be more economically obtained from a fixed structure than a floating vessel.

However, fixed drilling rigs are extremely expensive, require a considerable lead time for manufacturing, and once set in place, cannot be relocated or conveniently expanded to meet drilling conditions which may be encountered in the future, or even worse, may not have been justified at all because of limited potential.

Figure 2:
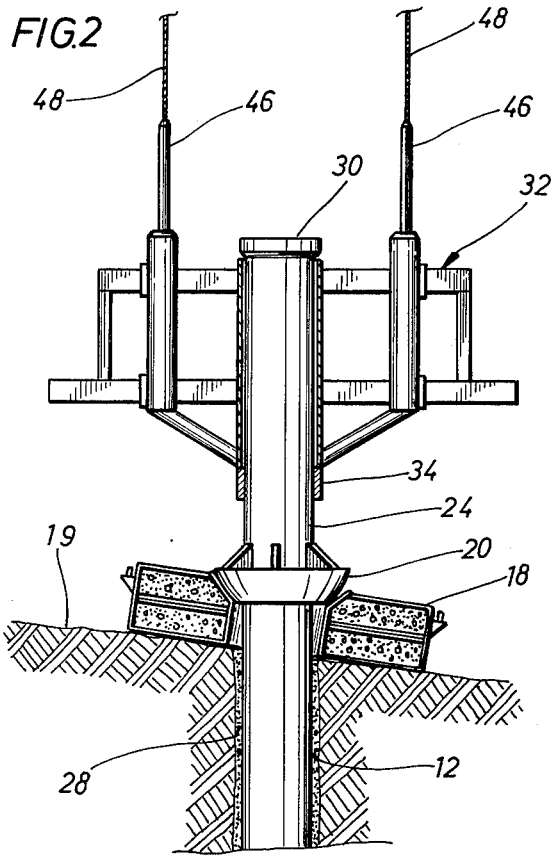
FIG. 2 is an elevational view showing a pipe cemented in place in the well and a modular guide base of the present invention supported therefrom.
Figure 3:
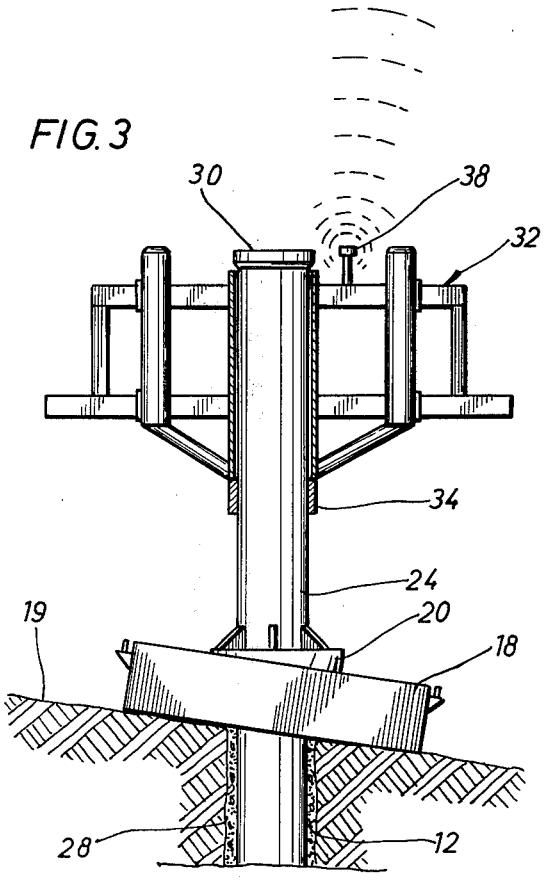
FIG. 3 is an elevational view, similar to FIG. 2, utilizing an acoustic type of guidance system for positioning subsequent components and other equipment to the modular base.

The present invention is directed to a modular underwater drilling platform in which the location and size of the platform is not committed until the size and location of the field is more fully defined as additional wells are drilled. Referring now to FIG. 2, after a well has been drilled as a conductor 24 is being installed a modular guide base of the present invention, generally indicated by the reference numeral 32, is installed and supported from the conductor 24 by any suitable means such as from a collar 34. As shown in FIG. 2, the guide base 32 may be oriented in any desired direction by means of suitable orientation means such as guide lines 48, or as shown in FIG. 3, an acoustical transducer 38 may be provided for locating the guide base 32 and for guidance and orientation of subsequent equipment. Preferably, the guide base 32 is positioned above the underwater floor 19 to allow additional modular units to be easily horizontally aligned with the first guide base 32 regardless of whether the underwater floor 19 is level or not.

Figure 4:
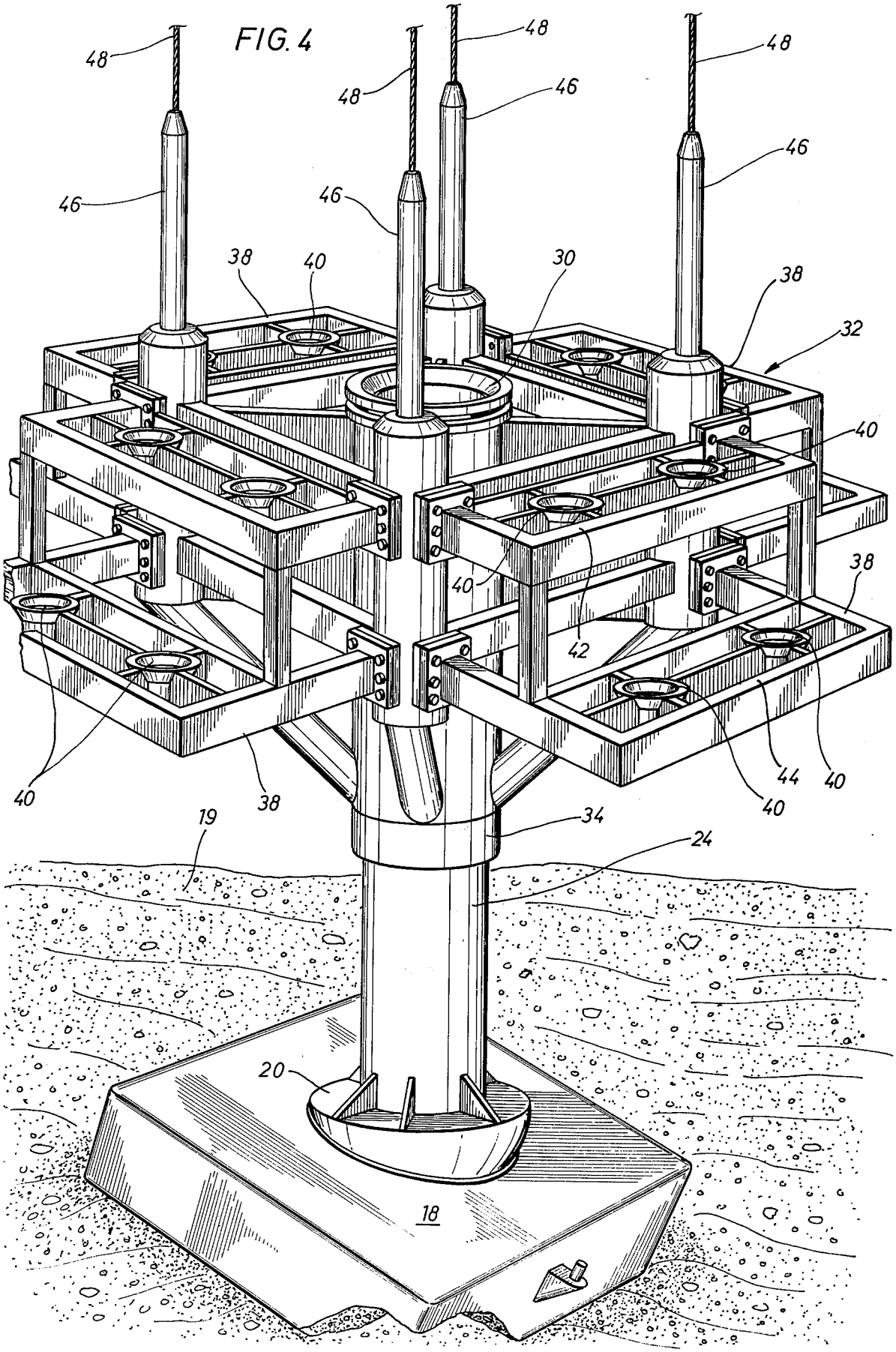
FIG. 4 is an enlarged isometric view of the modular guide base of the present invention supported in position from the underwater floor by a pipe.

Referring now to FIG. 4, the modular guide base 32 includes a plurality of connecting and supporting frames 38 here indicated as four, although any suitable number may be used, and directed outwardly in various directions, here shown as in four different directions. Each of the frames 38 includes interconnecting elements such as funnels 40 which telescopically engage coacting interconnecting elements, which will be more fully described hereafter, for connection to and support of other structural members in any desired direction. Preferably, each of the frames 38, include for greater strength, multiple horizontal supports or steps 42 and 44 which are positioned vertically with respect to each other with the lower support 44 extending horizontally a further distance outwardly than the upper support 42. Therefore, each of the frames 38 provides interconnecting and supporting elements which will telescopically accept and support another structural member for extending the modular platform in a desired direction.

While these modular guide bases 32 may be secured to the conductor pipe 24 by any suitable means, such as welding, the use of the collar 34 allows the first guide base 32 to be supported from the conductor pipe 24 and to be rotatable relative to the pipe 24 in order to provide greater flexibility by rotationally orienting the guide base 32 to direct the frames 38 in any desired direction for attaching the next platform structure.

The base 32 as shown will support additional structure members in any one of or a combination of various directions. The base 32 may also include a plurality of guide posts 46 connected to guide lines 48 for landing subsequent equipment and structural members onto the base 32.

After the first well is drilled through the first modular guide base 32 and the results indicate the positioning of the base of the drilling platform, additional structures may be connected to the first guide base 32.

Figure 5:
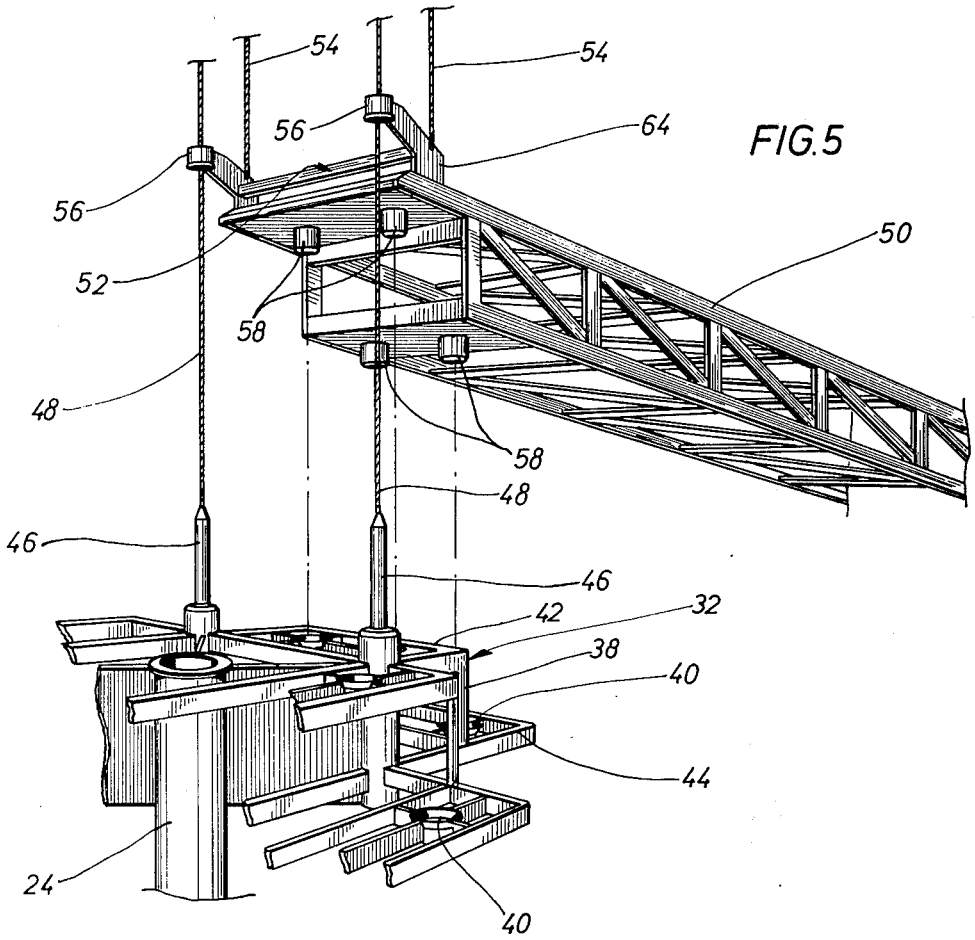
FIG. 5 is an isometric elevational view, illustrating a spacer member having one end being lowered into engagement with and supported from a modular guide base.
Figure 7:
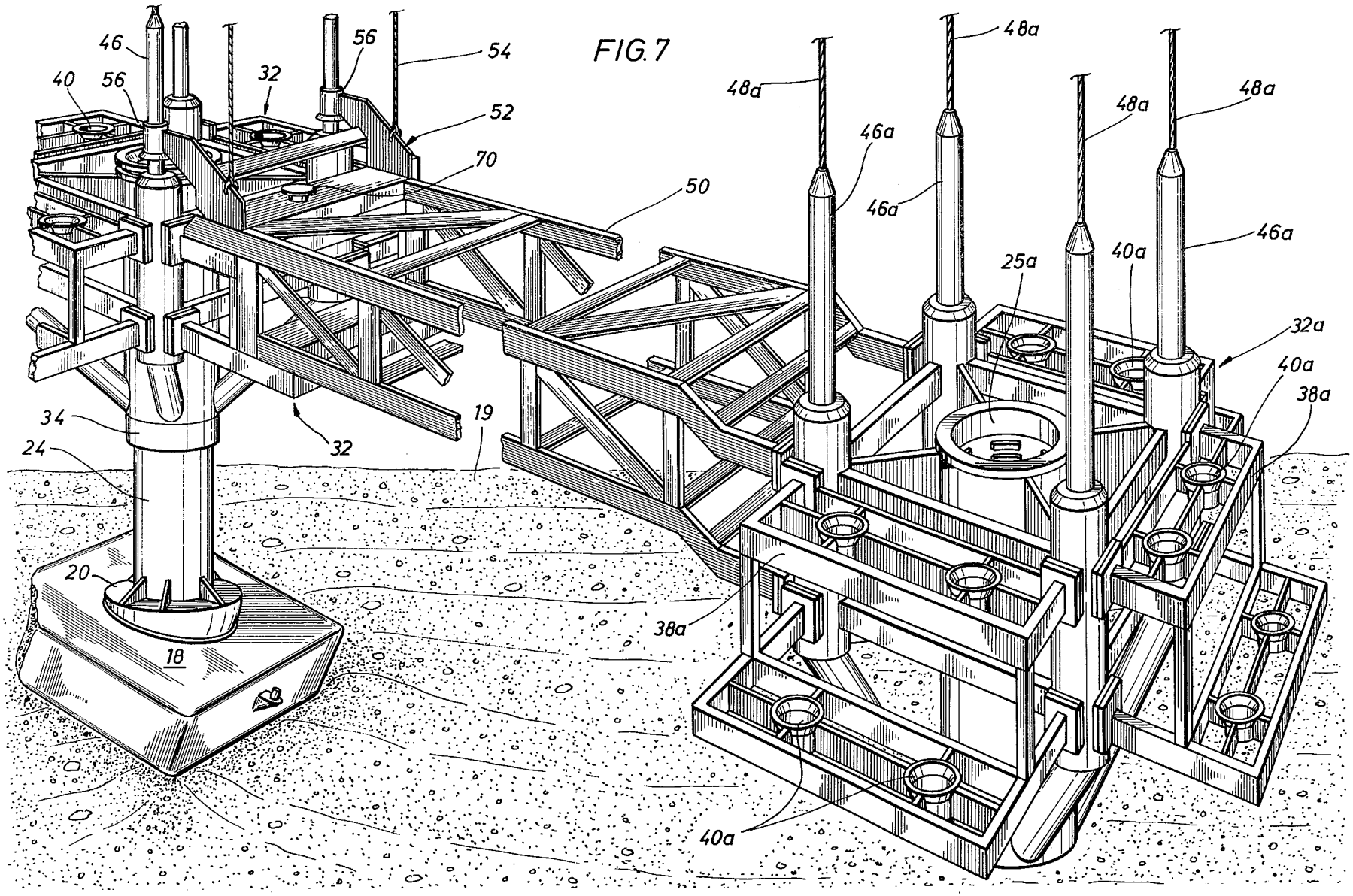
FIG. 7 is an isometric view illustrating the attachment of a spacer member and a second modular guide base to a first modular guide base.

Referring now to FIGS. 5 and 7, the sequence of attaching additional structural members to the first guide base 32 is best seen. FIG. 5 shows a spacer member 50, which may be of any desired length, being lowered into engagement and supported from the first guide base 32. A running tool 52 is releasably connected to the spacer member 50 and is in turn connected to running cables 54. The running tool 52 includes rings 56 to encircle the guide lines 48 and for engaging the guide posts 46 to accurately align the spacer member 50 with the selected frame 38 of the base 32. The spacer member 50 includes connector pins 58 for interconnecting with the funnels 40 of the base 32 to form telescoping members which provide the interconnection between the spacer member 50 and the base 32. The configuration of the ends of the spacer member 50 is such that it will engage and set on and be supported from the horizontal supports 42 and 44 of the base 32.

Figure 8:
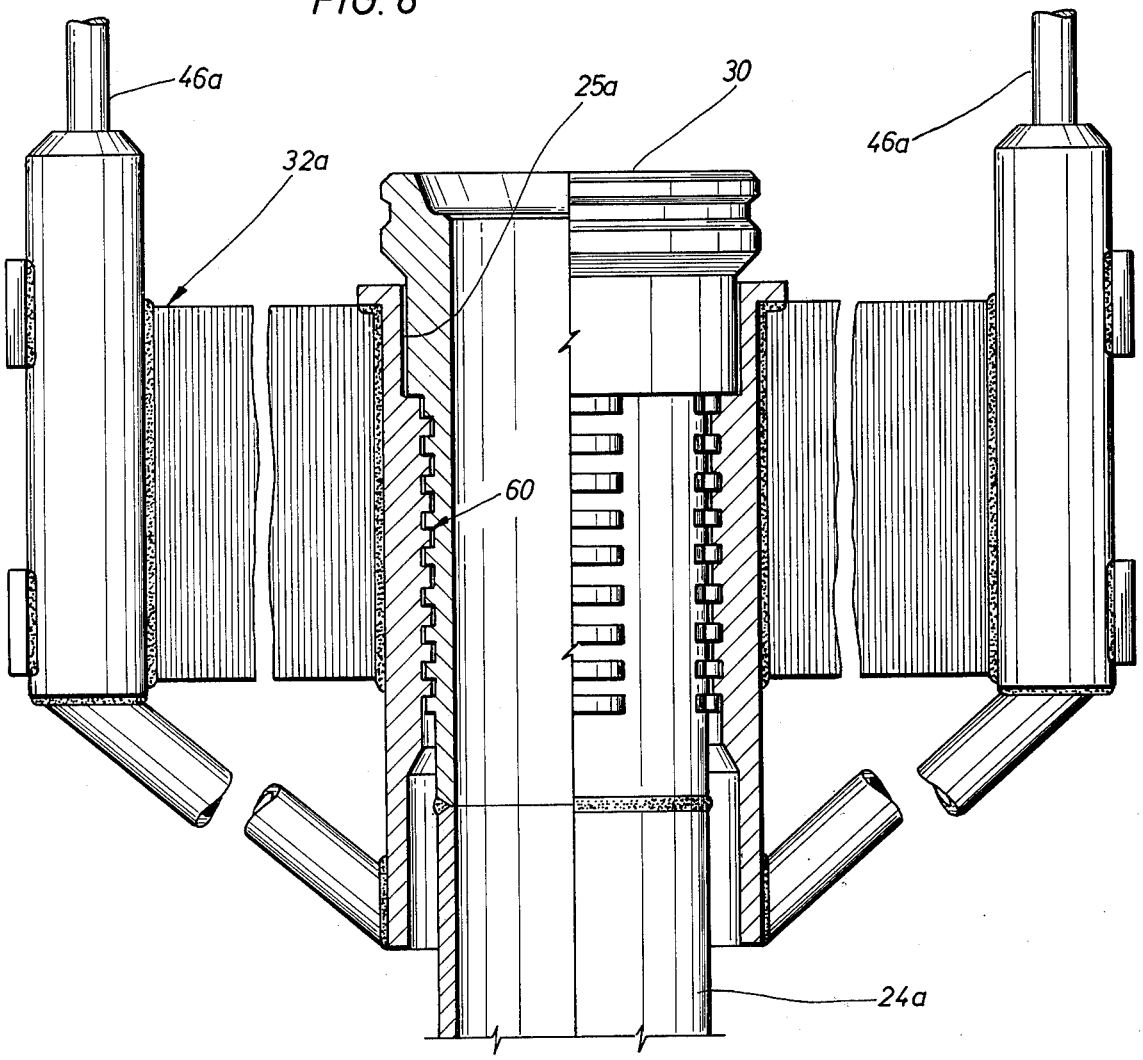
FIG. 8 is an enlarged elevational view, partly in cross section, of one type of connection between the supporting pipe and a guide base.

While the spacer member 50 may have a second end identical to the first end shown in FIG. 5, it is more convenient, as best seen in FIG. 7, to rigidly attach a second modular guide base **32*a* to the second end of the spacer member 50 by rigid connections, such as welding or bolts, for ease and accuracy of location of the second base 32*a*. Thus, as shown in FIG. 7, a spacer member 50 and a second guide base 32*a* are connected together above the water surface and simultaneously lowered by means of the running cables 54 supporting one end of member 50 and guide lines 48*a* connected to the second base 32*a*. The spacer member 50 and base 32*a* are lowered until the connecting pins 58 telescopically engage the funnels 40 of the first guide base 32. The second guide base 32*a* is held in position until a hole may be drilled through the opening 25*a* in the underwater floor and a conductor pipe 24*a* placed in the opening 25*a* and cemented into the underwater floor to provide a structure to rigidly support the second modular guide base 32*a* from the underwater floor as best shown in FIG. 8. While any suitable connection may be made between the conductor pipe 24***a* and the opening 25*a* of the second guide base 32*a*, a conventional breach lock connection generally shown in FIG. 8 and indicated by the reference numeral 60 may be provided.

Figure 9:
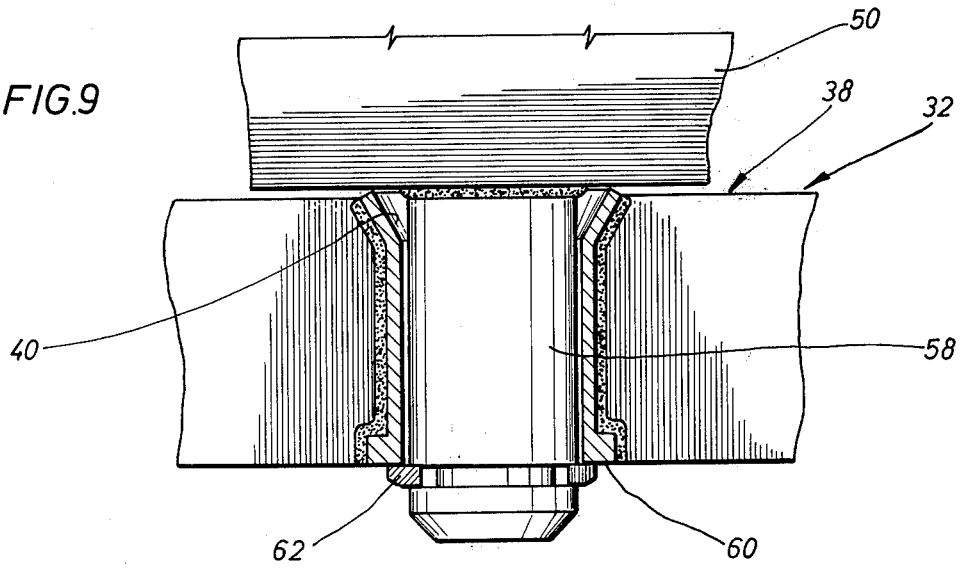
FIG. 9 is an enlarged fragmentary elevational view, partly in cross section, illustrating the locking of a spacer member to the modular guide base.

Referring now to FIG. 9, the interconnection of the spacer member 50 and the modular guide base 32 is best seen in which one of the connecting pins 58 on the spacer member 50 is shown in telescopic engagement with one of the funnels 40 on one of the frames 38 for locking and supporting the spacer member 50 in position. Suitable locking means is provided which includes a shoulder 60 at the bottom of the funnel 40 and a resilient locking ring 62 carried by the connecting pin 58 which will retract as the pin 58 is pushed through the funnel 40 and will thereafter expand into engagement with the shoulder 60 for securing the spacer member 50 in engagement with the frame 38.

Figure 6:
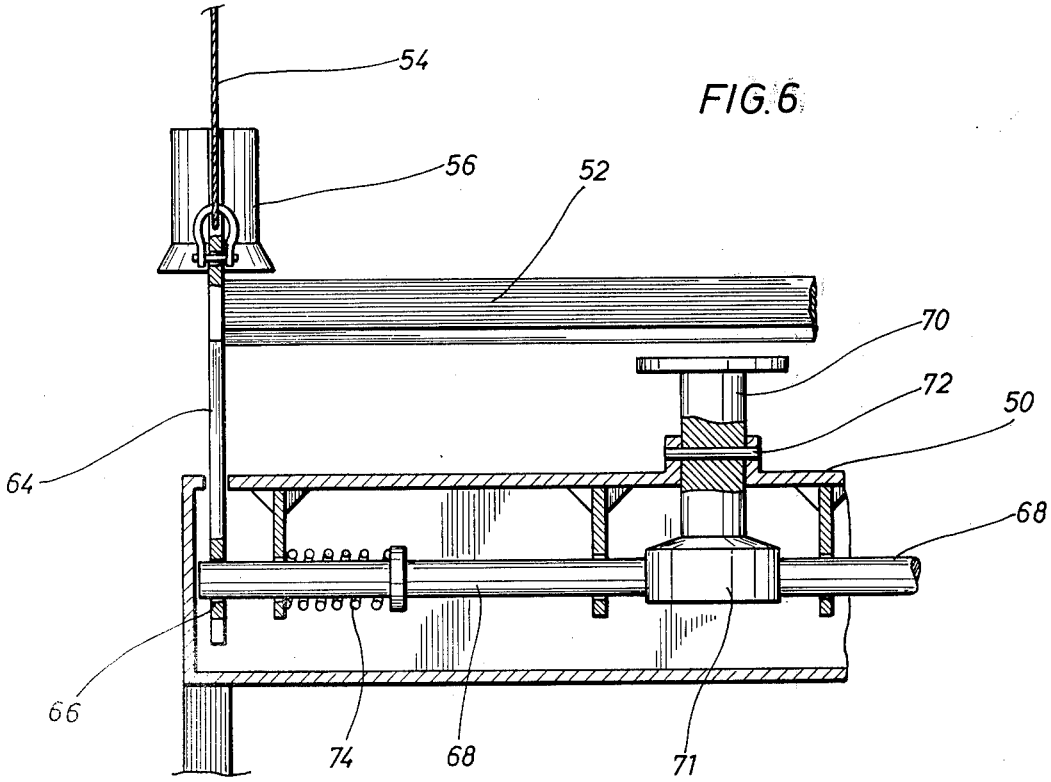
FIG. 6 is an enlarged fragmentary elevational view, partly in cross section, illustrating the releasable connection between a running tool and a spacer member for lowering the spacer member into engagement with a modular guide base.

After the modular guide base 32*a* is set in place, and secured to and supporting from a conductor 24*a* from the underwater floor, the running tool 52 may be disconnected from the spacer member 50. As best seen in FIG. 6, the running tool 52 may be releasably connected to the spacer member 50 by one or more supports 64 having openings 66 therein. The spacer member 50 includes a plurality of engaging rods 68 which are initially extended through the openings 66 for supporting the frame 50 therefrom. The rods 68 are held in an extended position by a latch pin 70 releasably secured to the frame 50 by a shear pin 72 thereby holding the rods 68 in an extended and engaging position against resilient springs 74. After the spacer member 50 is moved into position, as best seen in FIG. 7, a weight (not shown) is dropped downwardly along the running cables 54 to engage the top of the latch pin 70 shearing the pin 72 and moving the enlarged portion 71 of the latch pin 70 out of engagement with the ends of the engaging rod 68. The springs 74 will then retract the rod 68 from the openings 66 and allow the running tool 52 to be released from the frame 50.

Figure 10:
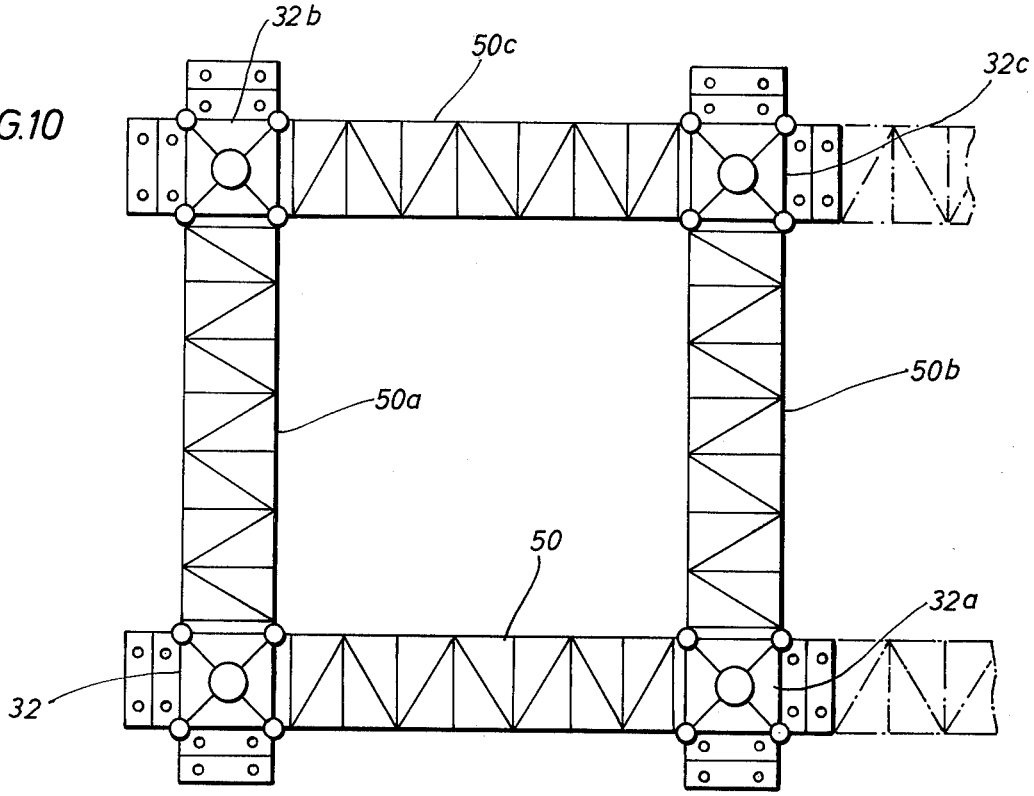
FIG. 10 is a plan view of a modular underwater drilling platform composed of modular guide bases and spacer members of the present invention.

Referring again to FIG. 7, it is to be noted that the second guide base 32*a* also includes a plurality of frame members 38*a* extending in various directions for receiving additional interconnecting structural components for extending the base of the drilling platform in any desired direction as dictated by drilling results encountered through either the conductor pipe 24 or 24*a* or from any other location. For example, as best seen in FIG. 10, additional interconnection modular units may be connected to the structure shown in FIG. 7. For example, a second spacer member 50*a* and connected modular guide base 32*b* may be connected to the first guide base 32, and a third spacer member 50*b* and connecting modular guide base 32*c* may be connected to the guide base 32*a*. While as has previously been indicated and shown in FIG. 7, it is preferable to lower into the water a spacer member 50 having a modular guide base, such as 32*a*, already connected to the second end of the spacer member 50, in the event that the components are of such a size that it is desired to set the modular guide bases 32*a*, 32*b* and 32*c* separately, they may be individually set and in that event the spacer members 50, 50*a* and 50*b* would include telescoping interconnecting members at both ends such as the connecting pins 58 shown in FIG. 5. And, of course, the spacer member 50*c* shown in FIG. 10 would require telescoping interconnecting members at both ends for connecting to the already set modular guide bases 32*b* and 32*c* for providing the desirable structural strength therebetween. The advantages of the modular platform of the present invention is apparent in FIG. 10 wherein the location and size of the platform is not committed until the field size and location has been defined as the wells are drilled. In addition, the modular guide bases 32 and frames 50 may be manufactured at different locations with a short lead time, can be made up and stocked for future use, and the platform can be expanded in any direction as drilling conditions dictate at a later date. The configuration shown in FIG. 10 may provide the base for a conventional four-legged drilling rig or alternatively may form the base of a single leg of the drilling platform.

Figure 11:
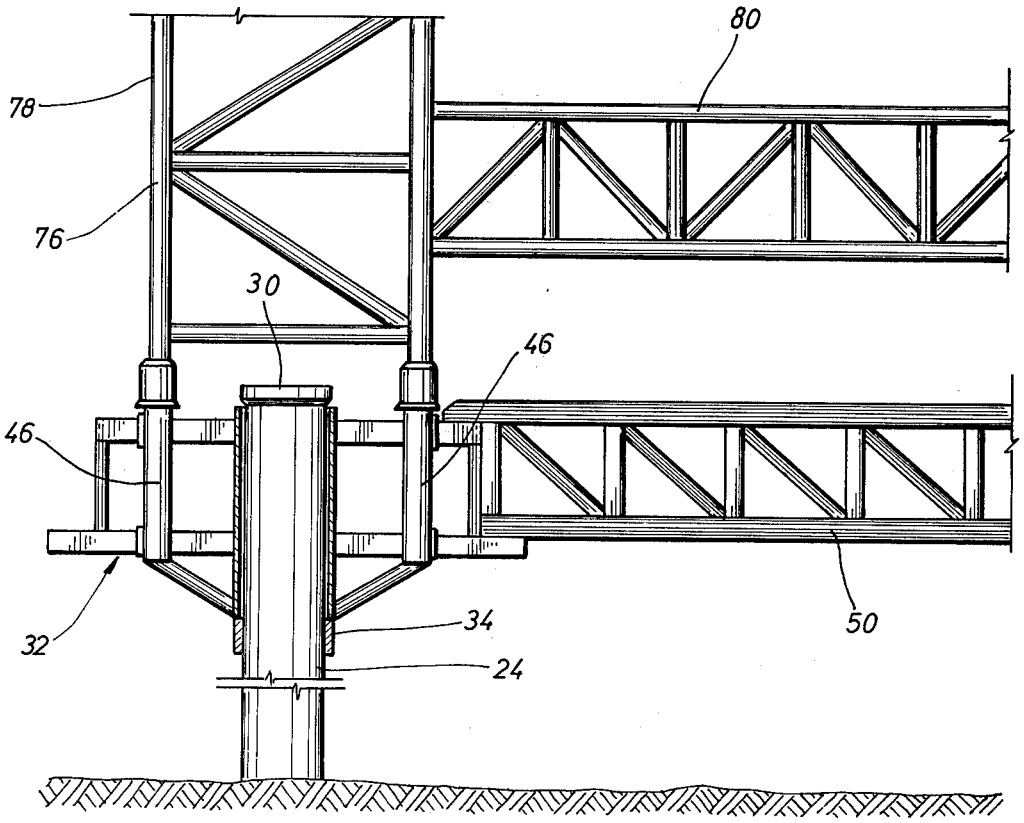
FIG. 11 is a fragmentary elevational view, illustrating the positioning of an upper support structure being supported from a modular guide base.
Figure 12:
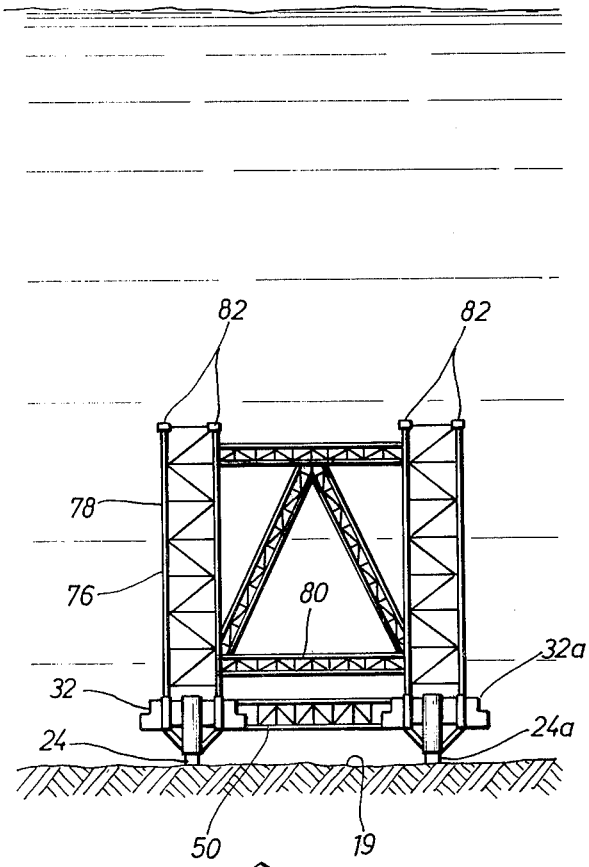
FIG. 12 is an elevational view showing a permanent upper support portion of a platform lowered into position and connected from the modular guide bases and spacer members.
Figure 13:
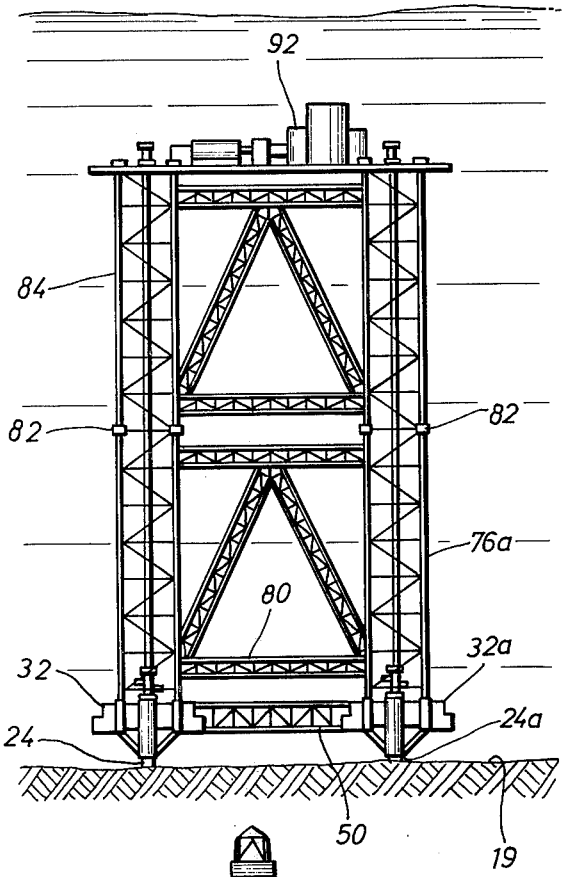
FIG. 13 is an elevational view of an underwater drilling platform having a second modular upper section which is completed below the surface of the water.
Figure 14:
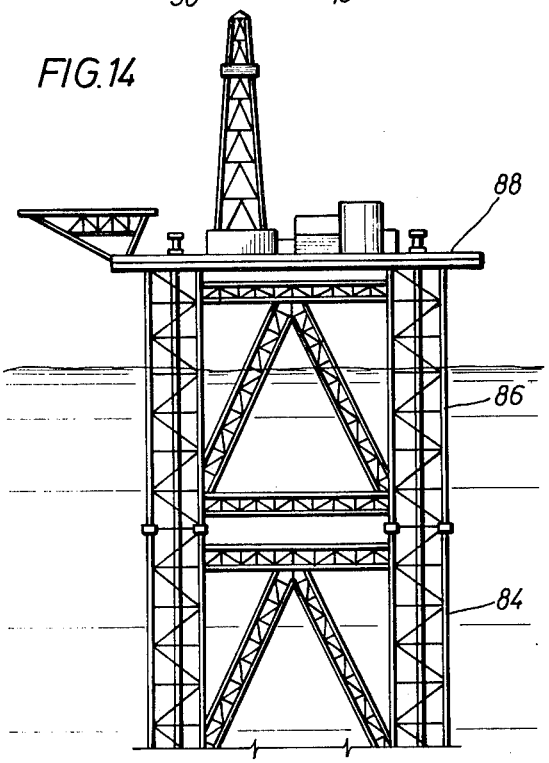
FIG. 14 is an elevational view of an underwater drilling platform showing a second modular upper section added to complete the platform above the water surface.
Figure 15:
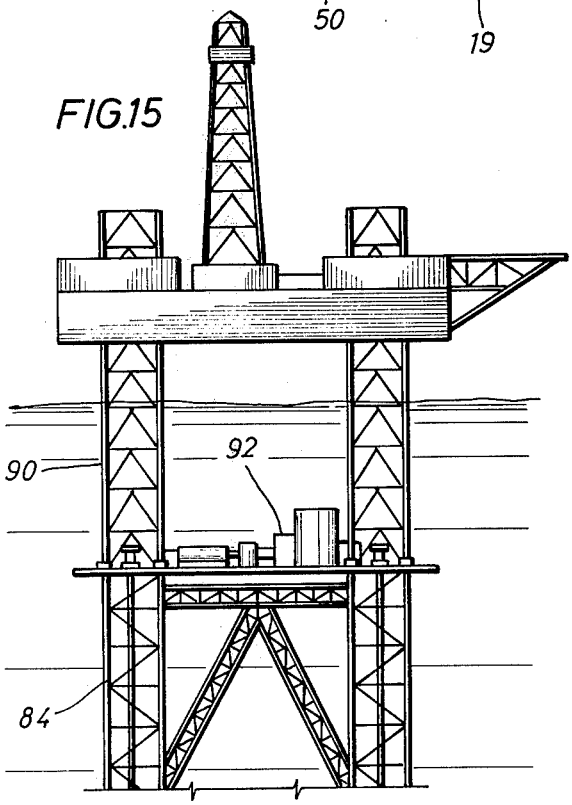
FIG. 15 is a partial elevational view of an underwater drilling platform completed below the water level but having a jackup rig positioned on top of the permanent platform.

After the leg of the drilling platform consisting of the modular guide bases 32 and spacer members 50 have been positioned, upper structural members may be lowered and connected to the base, as best seen in FIGS. 11 and 12, 13, 14 and 15 for completing the platform. Referring to FIGS. 11 and 12, an upper support structure generally indicated by the reference numeral 76 may be lowered onto the guide posts 46 of the modular bases 32 to telescope and seat thereon and may include upright supports 78 and cross bracing 80. The structure 76 may also be modular structured in height to allow the drilling platform to be installed in any desired water depth. The modular support structure 78 may include telescoping connections for receiving additional modular support structures, such as modular support structure 84 (FIG. 13), to complete the platform beneath the surface of the water whereby the top of the support 84 may be diver accessible but below the danger level of passing ships and damage from storms. Suitable platform well control and processing equipment may be supported therefrom. Or, as best seen in FIG. 14, the upper modular support structures 84 and 86 are completed above the surface of the water to provide a platform 88 for the usual production or drilling equipment. Or, as best seen in FIG. 15, the platform consisting of section 84 may be completed below the water surface and a conventional jack-up rig 90 may be provided to coact therewith and be supported from the upper section 84 to provide a releasable drilling and/or servicing platform extending above the water, which may be removed in the event of storms, while leaving the usual completion equipment 92 positioned beneath the water surface on the upper structure 84.

Figure 16:
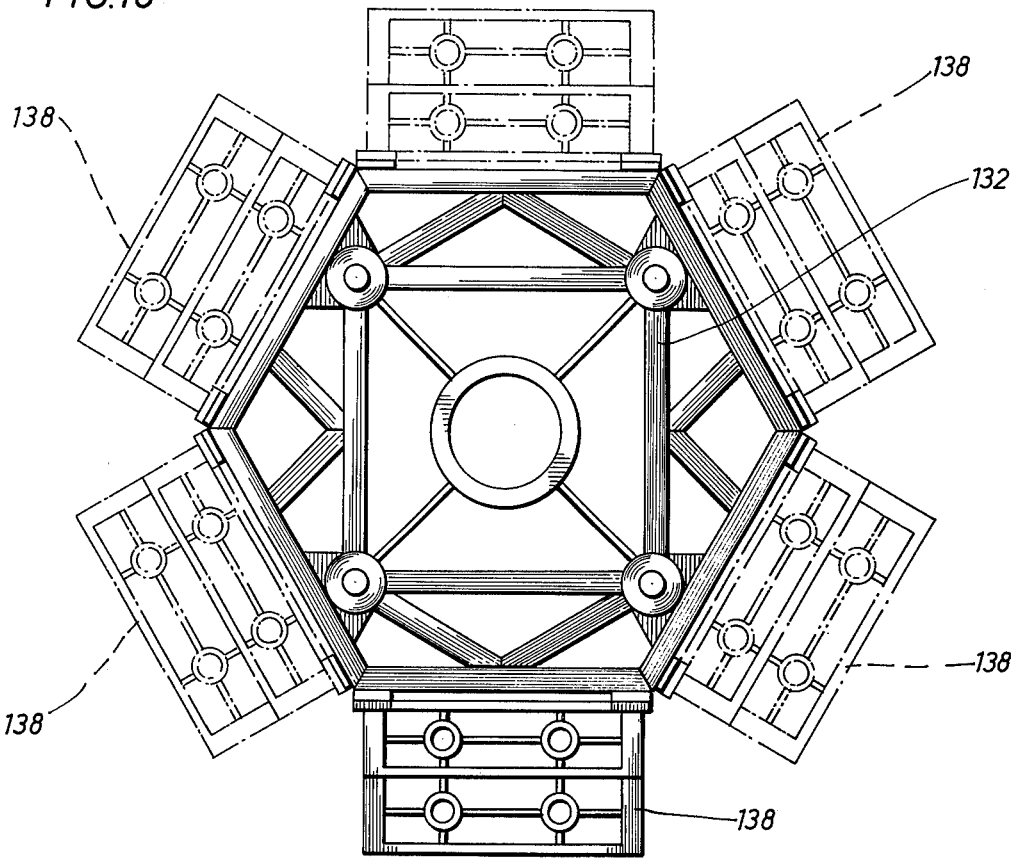
FIG. 16 is a plan view of a modified modular guide base in which the connecting and supporting frames are directed in different directions than the embodiment of FIG. 4.
Figure 17:
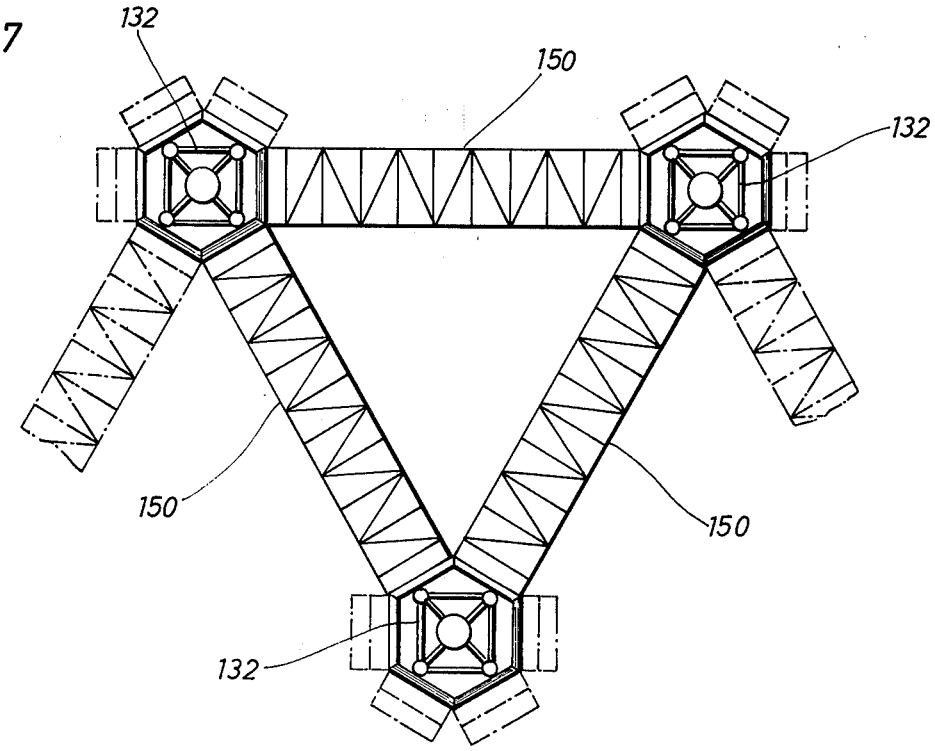
FIG. 17 is a plan view of the base of an underwater drilling platform using the modular guide base of FIG. 16.

While the modular guide base 32, as shown in FIGS. 1–15, has shown that the connecting and supporting frames 38 may be directed in various directions, another modular guide base 132, as best seen in FIGS. 16 and 17, is shown in which a plurality of connecting and supporting frames are provided showing that the modular bases of the present invention may be utilized to provide drilling platforms other than the usual rectangular shape. In the embodiment shown shown in FIGS. 16 and 17, the guide base 132 is shown with six frames 138 which can be interconnected by one or more spacer members 150 to provide varying types of supporting structures as may be dictated by drilling results and environmental conditions encountered.

The present invention, therefore, is well adapted to carry out the objects and attain the ends and advantages mentioned as well as others inherent therein. While the presently preferred embodiment of the invention has been given for the purpose of disclosure, numerous changes in the details of construction and arrangement of parts may be made without departing from the spirit of the invention and the scope of the appended claims.

What is claimed is:

1. A modular underwater well drilling platform comprising, a first guide base adapted to be connected to a well member at the underwater floor, said base including a plurality of connecting and supporting frames directed outwardly in various directions and having interconnecting elements for allowing interconnection with additional guide bases in any of the various directions, said base including an opening for passage of a drill pipe.

2. The apparatus of claim 1 including, locating and positioning means connected to the guide base for positioning the guide base relative to the well member.

3. The apparatus of claim 1 wherein the guide base includes a circular opening for connection to and supported from a pipe connected to the underwater floor and the base is rotatable relative to the pipe.

4. The apparatus of claim 1 including, a spacer member having first and second ends each having an interconnecting element, said interconnecting element on said first end adapted to be connected to one of said connecting and supporting frames of said first guide base, and a second guide base adapted to be connected to the interconnecting element on the second end of the spacer member, and means for supporting said second guide base from the underwater floor.

5. The apparatus of claim 4 wherein the interconnecting elements include telescoping members for telescoping with the first and second guide bases.

6. The apparatus of claim 5 wherein the interconnecting elements include locking means for locking the spacer member to the first and second guide bases.

7. A modular underwater well drilling platform comprising, a first guide base secured to a pipe which is secured to the underwater floor, said first base including an opening for passage of a drill pipe, said first base including a plurality of connecting and supporting frames directed outwardly in various directions and having interconnecting elements for allowing interconnection therewith, a plurality of spacer members having first and second ends, each end having an interconnecting element, said interconnecting element on said first end adapted to be connected to the interconnecting elements of one of the frames of the first guide base, a plurality of additional guide bases each of which is adapted to be connected to the second end of one of the spacer members, said additional guide bases including a plurality of connecting and supporting frames directed outwardly in various directions and having interconnecting elements for allowing interconnection to a spacer member, and means for supporting said additional guide bases from the underwater floor.

8. The apparatus of claim 7 wherein each of the additional guide bases include an opening for passage of a drill pipe.

9. The apparatus of claim 7 wherein the connecting and supporting frames include more than one horizontally extending support positioned vertically with respect to each other with the lower supports extending horizontally a further distance than the upper supports.

10. The apparatus of claim 7 wherein the first guide base includes a circular opening for connection to and supported from a pipe connected to the underwater floor and the first base is rotatable relative to the pipe.

11. The apparatus of claim 7 wherein the first guide base is secured to the pipe at a position above the underwater floor.

12. The apparatus of claim 7 wherein the interconnecting elements include telescoping members for telescoping with said guide bases.

13. The apparatus of claim 12 wherein the interconnecting elements including locking means for locking the spacer members to the guide bases.

14. The apparatus of claim 7 wherein each of the guide bases include vertical guide means connected to the guide bases.

15. The apparatus of claim 14 including, an upper support structure having vertical guide means for coacting with the vertical guide means on the guide bases for supporting the upper support structure from the guide bases.

* * * * *